United States Patent [19]

Weber

[11] 4,002,320

[45] Jan. 11, 1977

[54] RAIL-LIFTING IMPLEMENT

[76] Inventor: Walter Weber, Sanatoriumstr. 35, Vienna 14, Austria

[22] Filed: Oct. 29, 1975

[21] Appl. No.: 626,873

[30] Foreign Application Priority Data

Oct. 31, 1974 Austria ..... 8797/74

[52] U.S. Cl. ..... 254/121; 104/1 R

[51] Int. Cl.[2] ..... E01B 29/22

[58] Field of Search ..... 104/7 R, 1 R, 2; 254/121, 43, 44, 8 R, 8 B, 8 L, 15, 17, 120, 124

[56] References Cited

UNITED STATES PATENTS

| | | | |
|---|---|---|---|
| 1,568,600 | 1/1926 | Hackmann | 254/121 |
| 1,590,450 | 6/1926 | Sinning | 254/121 X |

FOREIGN PATENTS OR APPLICATIONS

| | | | |
|---|---|---|---|
| 1,245,406 | 7/1967 | Germany | 254/44 |
| 1,021,400 | 12/1957 | Germany | 254/121 |

*Primary Examiner*—Robert G. Sheridan
*Assistant Examiner*—Randolph A. Reese
*Attorney, Agent, or Firm*—Karl F. Ross; Herbert Dubno

[57] ABSTRACT

A frame comprises cross-members. Two longitudinal beams are associated with the frame. At least one of the beams is detachably associated with the cross-members. An arm extends transversely to the beams between the same and is pivotally connected to the frame by an articulated joint. A drive mechanism is provided to impart a pivotal movement to the arm about the articulated joint. Upwardly facing, low-friction bearings are carried by the arm between the beams and spaced from the articulated joint. The frame is adapted to be pushed under a rail and to assume a condition in which the beams extend along the rail on opposite sides thereof and rest on two spaced apart ties supporting the rail and the bearings engage the rail from underneath between the ties.

5 Claims, 5 Drawing Figures

RAIL-LIFTING IMPLEMENT

This invention relates to an implement for lifting rails which lie on ties or sleepers, comprising a frame which is adapted to be pushed under a rail and an arm which is pivoted to said frame and connected to drive means and provided with supports for the rail in that portion of the arm which is remote from its pivot.

Known implements of this kind are supported at least on one side on the ballast bed and cause the rails to be virtually held fast on the supports owing to the high friction. For this reason the known implements have particularly the disadvantage that the rails when lifted cannot move freely in their longitudinal direction so that the rails are not free to expand, e.g., when welding operations have been performed on them. Besides, the known implements can easily subside.

It is an object of the invention to provide an implement which is of the kind defined first hereinbefore and which is free of the disadvantages which have been described. This object is accomplished by two beams which are associated with said frame and when the implement is in its operating condition extend on both sides of the rail and are adapted to be supported on two adjacent ties or sleepers, at least one of said beams is detachably associated with cross-members of the frame, and the supports for the rail consist of low-friction bearings. In an implement according to the invention the rails rest freely on the supports, which are raised as a result of the upward pivotal movement of the arm, so that the implement can neither subside nor slip.

The rails will be even more easily movable on their supports if, according to a further feature of the invention, the supports consist of balls which are freely rotatably mounted.

To enable an adaptation of the balls to the inclination of the bearing surface of the rail foot, it may be desirable to mount the arm on the frame for pivotal movement on two mutually transverse axes. The same result will be produced if at least three supports are mounted in a plate which is pivoted to the frame on two mutually transverse axes.

To enable a levelling, the beam which is detachably associated with the cross-members may be adapted to be joined to the cross-members on different levels.

Embodiments of the invention will now be described more fully and by way of example with reference to the accompanying drawings, in which FIG. 1 is a side elevation showing an implement according to the invention, partly in a sectional view taken on line I—I in FIG. 2, which is a fragmentary top plan view showing one-half of the implement.

Figure 1:
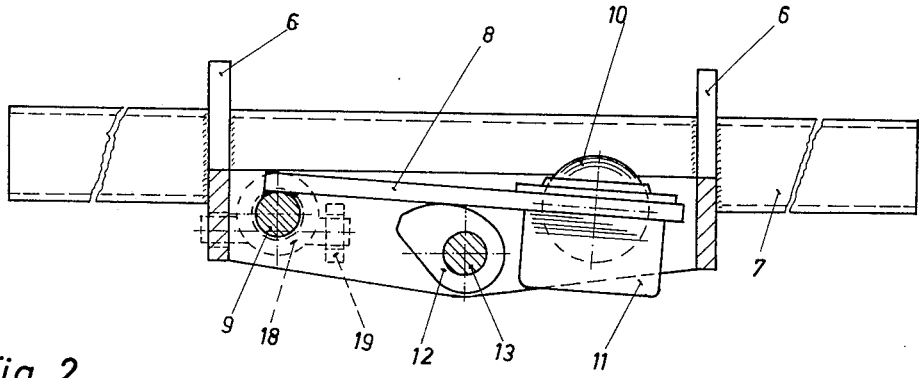
Figure 2:
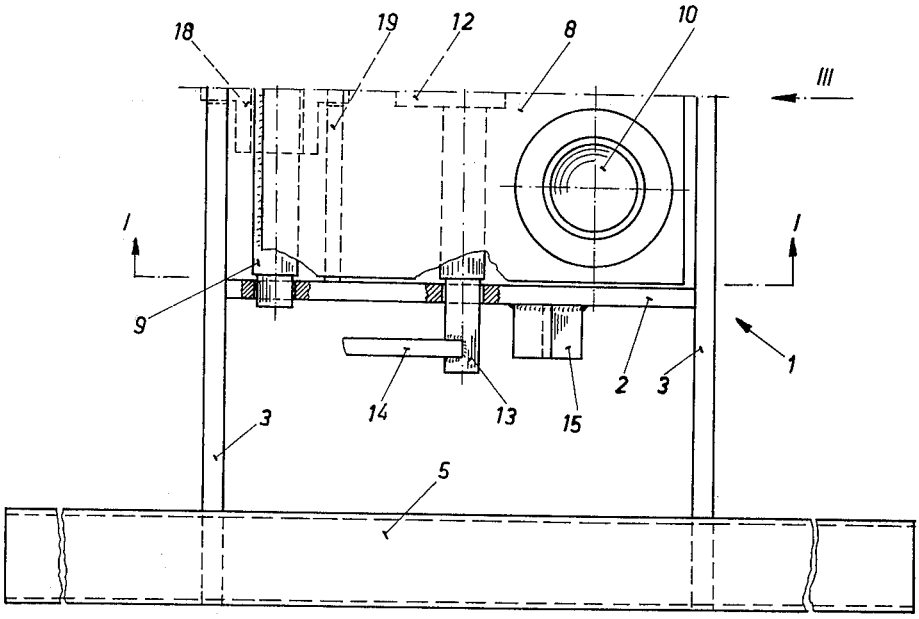
Figure 3:
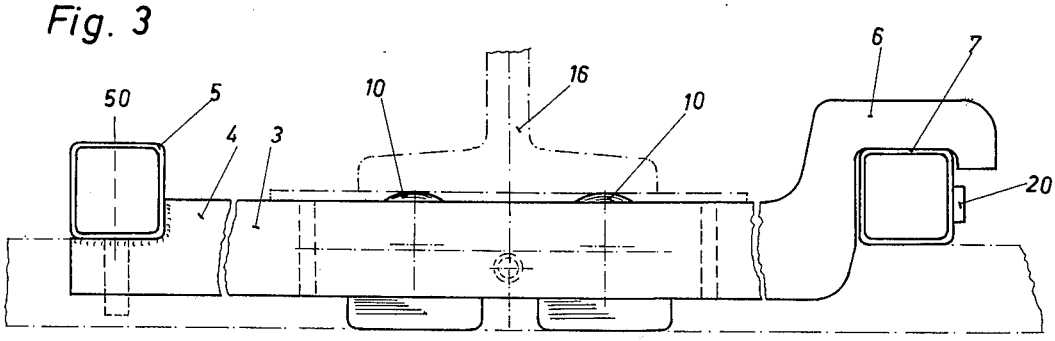
FIG. 3 is an elevation showing the implement as viewed in the direction of the arrow III in FIG. 2.

In accordance with FIGS. 1 to 3, a frame 1 comprises two longitudinal beams 2, which extend between and are welded to two cross-members 3. A beam 5 is welded to the cross-members 3 at one end 4 of the latter. At their other ends 6, the cross-members 3 are offset and during the use of the implement rest on a beam 7.

In the version represented in solid lines in FIG. 2, a platelike arm 8 is welded to a shaft 9, which is rotatably mounted at both ends in the longitudinal beams 2. Balls 10 are provided in the region which is opposite to the pivotal shaft 9. Each ball 10 is freely rotatably mounted in a cage 11 in known manner. Between the shaft 9 and the balls 10, the arm 8 is engaged by a cam 12, which is secured to a shaft 13. The shaft 13 is rotatably mounted at both ends in the longitudinal beams 2. A lever 14 is welded to the shaft 13 at one protruding end of the latter. One of the longitudinal beams 2 is provided with a stop 15 for limiting the movement of the lever 14.

When it is desired to lift a rail 16 by means of the implement, the latter is pushed under that rail, with the offset ends 6 ahead, until the ends of the beam 5 rests on two adjacent ties or sleepers. On the other side, the beam 7 lying on the ties or sleepers 17 is pushed under the offset ends 6 of the cross-members 3. The lever 14 is subsequently operated to impart a pivotal movement to the cam 12 by means of the shaft 13 so that the arm 8 is rotated on its shaft 9 and the balls 10 lift the rail 16. Because the balls 10 are freely rotatable, the rail 16 can move in all directions.

To ensure that all balls support the rail 16 even if the bearing surface of the latter is inclined, the version indicated in dotted lines may be adapted. In that version, the shaft 9 is not rotatably mounted in the longitudinal beams 2 but is rotatably mounted in a coupling member 18, which is mounted in a cross-member 3 or an intermediate member 19 for rotation on an axis which is transverse to the shaft 9. In this case the arm 8 is pivoted on two mutually transverse axes so that it can be adapted at any time to an inclination of the rail foot.

It will be understood that the beam 5 may be loose too; in this case the ends 4 must be offset or turned up or the beam 5 is provided with a depending lug 50 and the end 5 is fitted into said lug. This lug 50 is indicated by dotted lines in FIG. 3 and might be provided also on the beam 7 so that the end 6 need not be offset. It is apparent from FIG. 3 that a plate 20 has been welded to the beam 7 so that the same has different dimensions in cross-section in two directions at right angles to each other. In this case any difference in elevation can be compensated in that the beam is turned through 90°. If the beam 5 or 7 is provided with lugs 50, an adjustment in height will be enabled if the lug has steps on different levels.

Figure 4:
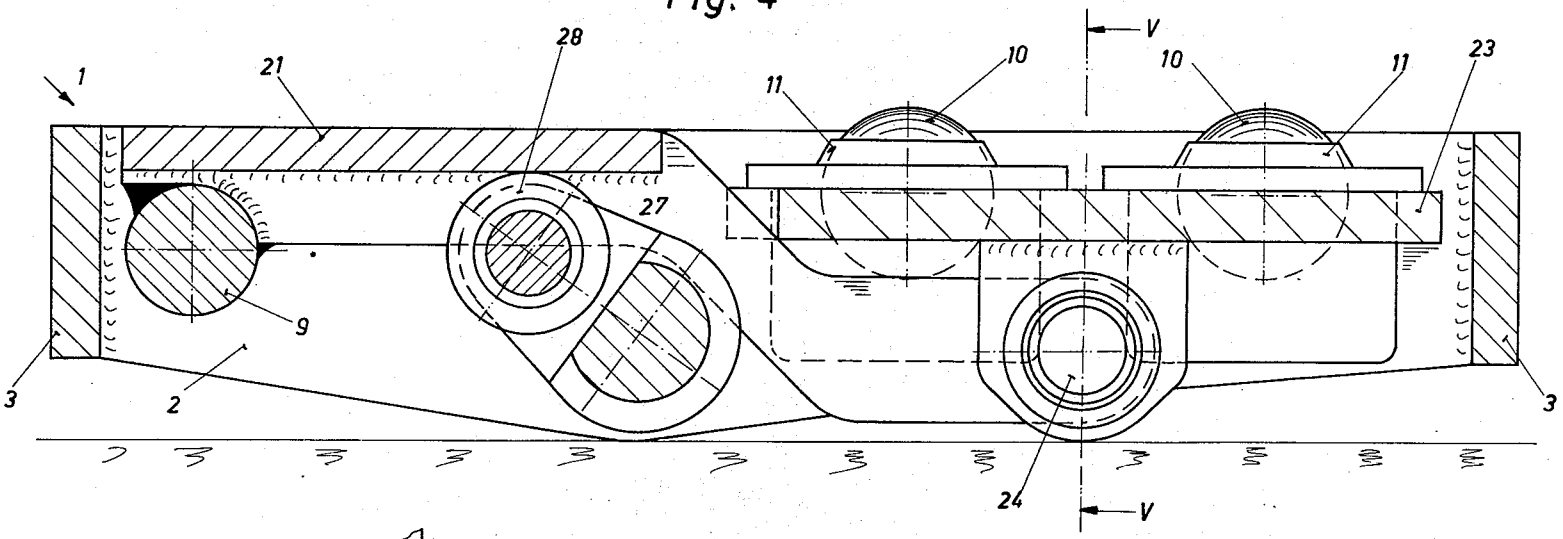
FIG. 4 is a sectional view showing another embodiment of the invention.
Figure 5:
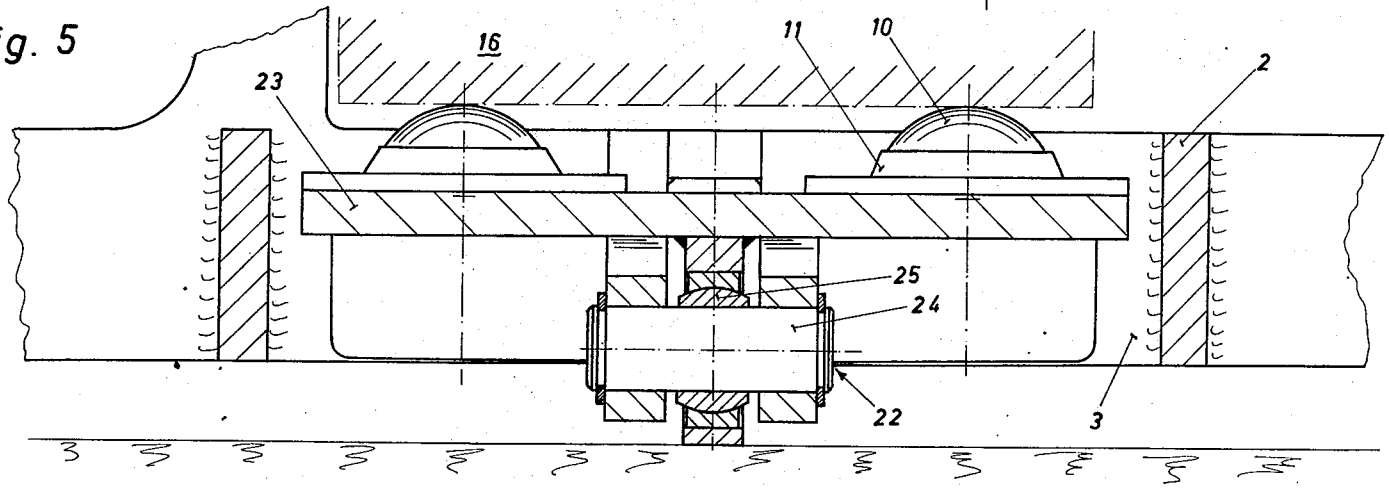
FIG. 5 is a sectional view taken on line V—V in FIG. 4.

Just as the first embodiment, the embodiment shown in FIGS. 4 and 5 comprises a frame 1 having longitudinal beams 2 and cross-members 3. A shaft 9 is also rotatably mounted in the longitudinal beams 2 and an arm 21 is welded to said shaft. At its end remote from the shaft 9, the arm 21 carries a plate 23 by means of a pivot bearing 22. The plate 23 carries four cages 11 with respective balls 10. Each pivot bearing 22 has a pivot 24, which is held in a spherical bearing member 25. This bearing member is held in a complementary spherical bearing 26, which is joined to the plate 23. The pivot 24 is rotatably mounted in the arm 21.

In this embodiment the plate 23 can rotate on the axis of the pivot 24 and on the pivotal axis of the bearing member 25, which is at right angles to the axis of the pivot 24, so that the balls 10 can adjust to an inclination of the rail 16.

In this embodiment the cam for raising the arm 21 consists of a crank 27 provided with a rolling-element bearing 28, so that the friction is lower than in the first embodiment comprising a cam 12.

Numerous alterations are possible within the scope of the invention. Whereas the use of balls 10 has proved highly satisfactory, they might be replaced by rollers or different supports which provide a freedom of movement for the rail 16. The drive means and the design of the frame could also be altered.

What is claimed is:

1. An implement for lifting a rail which lies on ties, comprising a frame comprising cross-members, two longitudinal beams associated with said frame, at least one of said beams being detachably associated with said cross-members, an arm extending transversely to said beams between the same, an articulated joint pivotally connecting said arm to said frame, drive means operable to impart a pivotal movement to said arm about said articulated joint, and upwardly facing, low-friction bearing means carried by said arm between said beams and spaced from said articulated joint, said frame being adapted to be pushed under a rail and to assume a condition in which said beams extend along said rail on opposite sides thereof and rest on two spaced apart ties supporting said rail and said bearings engage said rail from underneath between said two ties.

2. An implement as set forth in claim 1, in which said bearing means comprise at least one ball.

3. An implement as set forth in claim 1, in which said articulated joint connects said arm to said frame for pivotal movement on two mutually transverse axes.

4. An implement as set forth in claim 1, in which a plate is mounted on said arm for pivotal movement on two mutually transverse axes and said bearing means comprise at least three low-friction bearings mounted in said plate.

5. An implement as set forth in claim 1, in which said beam which is detachably associated with said cross-members is adapted to be joined to said cross-members in different elevations.

* * * * *